US005987757A

United States Patent [19]

Schmidt et al.

[11] Patent Number: 5,987,757

[45] Date of Patent: Nov. 23, 1999

[54] SCISSORS WITH MOVABLE GRIP EYE

[75] Inventors: Hardi Schmidt; Günther Pracht, both of Solingen, Germany

[73] Assignee: "Jaguar" Stahlwarenfabrik GmbH & Co. KG, Solingen, Germany

[21] Appl. No.: 08/981,691

[22] PCT Filed: Jun. 21, 1996

[86] PCT No.: PCT/DE96/01092

§ 371 Date: Jan. 6, 1998

§ 102(e) Date: Jan. 6, 1998

[87] PCT Pub. No.: WO97/02934

PCT Pub. Date: Jan. 30, 1997

[30] Foreign Application Priority Data

Jul. 8, 1995 [DE] Germany ..... 295 11 091 U
Mar. 15, 1996 [DE] Germany ..... 196 10 214

[51] Int. Cl.[6] ..... B26B 13/20

[52] U.S. Cl. ..... 30/341; 30/232

[58] Field of Search ..... 30/232, 254, 341

[56] References Cited

U.S. PATENT DOCUMENTS

| | | | |
|---|---|---|---|
| 606,472 | 6/1898 | Ogden | 30/341 |
| 923,734 | 6/1909 | Tindall | 30/341 |
| 1,317,041 | 9/1919 | Scott | 30/341 |
| 1,357,200 | 10/1920 | Kiefer | 30/341 |
| 2,640,264 | 6/1953 | Sullivan et al. | 30/341 |
| 3,951,013 | 4/1976 | Laurenti | 30/254 |
| 3,974,563 | 8/1976 | Koch | 30/341 |
| 4,091,539 | 5/1978 | Watanabe | 30/341 |
| 4,254,551 | 3/1981 | Megna et al. | 30/341 |
| 5,109,608 | 5/1992 | Pracht | 30/341 |

FOREIGN PATENT DOCUMENTS

| | | | |
|---|---|---|---|
| 2724852 | 12/1978 | Germany . | |
| 2811398 | 3/1979 | Germany . | |
| 207968 | 12/1923 | United Kingdom . | |
| WO 93/06977 | 4/1993 | WIPO | 30/341 |

*Primary Examiner*—Hwei-Siu Payer
*Attorney, Agent, or Firm*—Diller, Ramik & Wight, PC

[57] ABSTRACT

In scissors, especially haircutting scissors, with two handles (1, 2) and handle eyes (4) arranged at the ends of the handles, where at least one of the handle eyes (4) is provided with a movable grip eye (5) which accommodates the thumb or a finger of the person using the scissors, in order to guide the scissors with movable grip eye (5) precisely and to reliably position the grip eye (5) in the handle eye (4), it is envisaged that the grip eye (5) is enclosed by the corresponding handle eye (4) along the entire circumference and displays guide elements projecting radially outwards on both sides, which lie laterally against the handle eye (4), meaning that the grip eye (5) can rotate freely about the axis perpendicular to the handle eye (4), while being mounted in the handle eye (4) in such a way as to be incapable of rotation perpendicular to this axis. (FIG. 1)

2 Claims, 4 Drawing Sheets

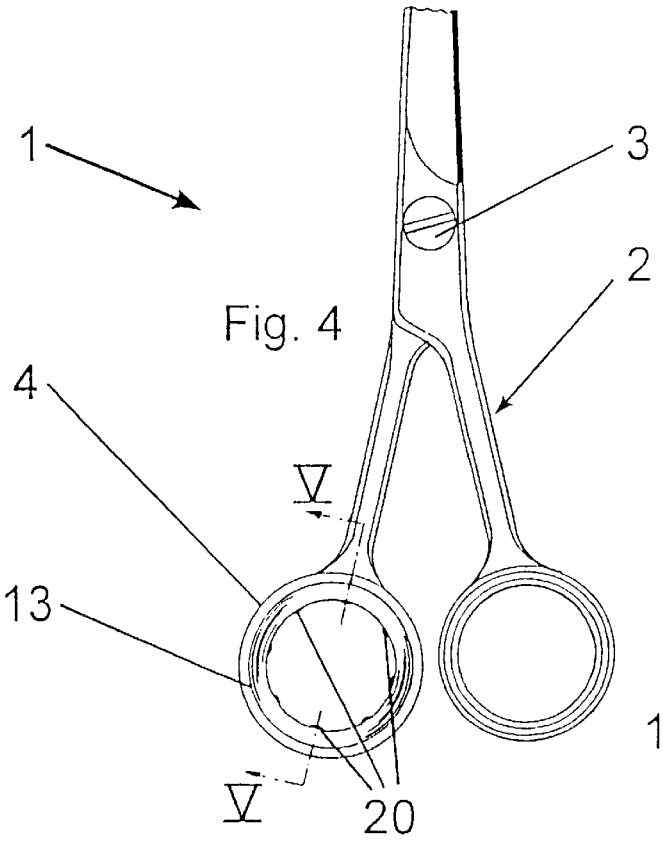
Fig. 4
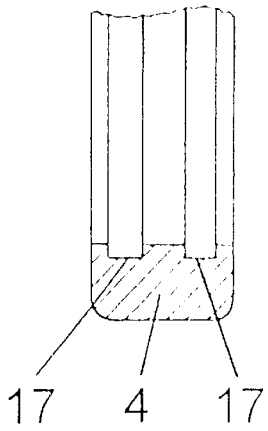
Fig. 8
Fig. 6
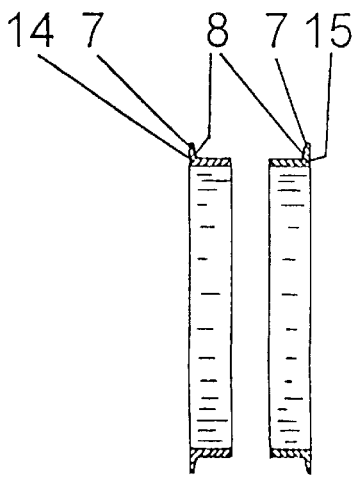
Fig. 5
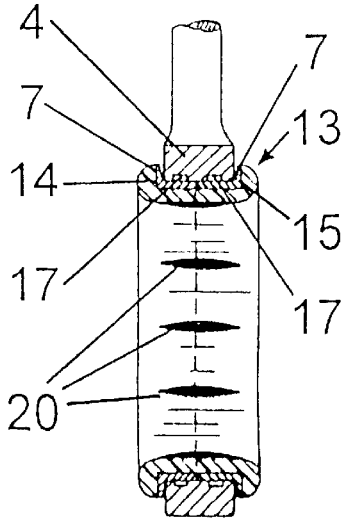
Fig. 7
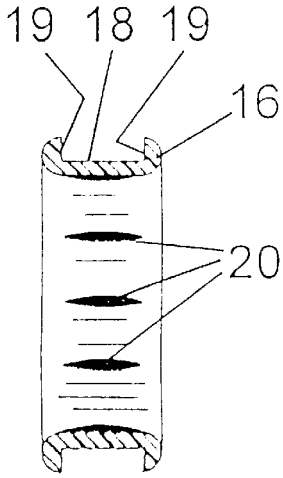

SCISSORS WITH MOVABLE GRIP EYE

BACKGROUND OF THE INVENTION

The present invention relates to scissors, especially hair-cutting scissors, with two scissor handles and handle eyes arranged at the ends of the handles, where at least one of the handle eyes is provided with a movable grip eye which accommodates the thumb or a finger of the person using the scissors, this grip eye being enclosed by the corresponding handle eye along its entire circumference and able to rotate freely about the axis perpendicular to the handle eye, while being mounted in the handle eye in such a way as to be incapable of rotation perpendicular to this axis.

Such scissors are known from document U.S. Pat. No. 2,640,264. In these scissors, the grip eye is mounted on the inside of the handle eye by way of a ball bearing. On the one hand, the ball bearing permits free rotation and, on the other hand, it ensures that the grip eye is positioned in the handle eye so as to be incapable of movement perpendicular to the axis of rotation. If the grip eye is to be replaced in order to ergonomically adjust it to the thumb or finger of the person using the scissors, this is not easily possible and can only be done by removing the balls in the type of bearing arrangement described. Furthermore, the scissors cannot be used without the grip eye.

A different type of scissors with movable grip eye is known from document DE-B-2811398. The outer side of the grip eye described in this document is of spherical design and arranged in a bearing of corresponding shape. The handle eye belonging to the grip eye is designed in forked fashion for radial insertion of the grip eye. In this context, the movable grip eye can be both rotated about the axis perpendicular to the handle eye and swivelled perpendicular to this axis, meaning that the thumb moves relative to the grip eye when using the scissors and that no pressure marks occur on the thumb when using the scissors over a lengthy period of time.

However, these scissors have the disadvantage that the simultaneous rotating and swivelling capacities of the grip eye in relation to the handle impair the controlled guidance of the scissors and that the thumb's freedom of movement is too great, which is perceived as annoying by the person using the scissors. Furthermore, the fork-shaped handle eye has the disadvantage that the grip eye can work its way out and hair can get trapped between the handle eye and the grip eye. Furthermore, dirt or other particles can also easily get between the handle eye and the grip eye from the open area of the handle eye. It can often be desirable to use the scissors without the movable grip eye, but this is impossible with the fork-shaped handle eye.

SUMMARY OF THE INVENTION

The present invention is based on the task of creating scissors of the kind mentioned at the start, which can be optionally used with different grip eyes or without a grip eye, where the easy and quick changing or removal of the grip eye rotating freely in the handle eye is of central importance.

According to the invention, the task is solved, on the one hand, in that the grip eye displays guide elements which project radially outwards on both sides and lie against the side of the handle eye, and in that the grip eye is made of flexible material, meaning that it can be snapped into and removed from the handle eye in the direction of the axis perpendicular to the handle eye.

Owing to the flexible material, the grip eye can be quickly and easily secured to the handle eye by way of the guide elements projecting radially outwards on both its sides, in such a way that it is freely rotatable in the secured position. The guide elements projecting radially outwards on both sides of the grip eye permit reliable arrangement of the grip eye in the handle eye, so that it is mounted in the handle eye in such a way as to be incapable of movement perpendicular to the axis of rotation.

The guide elements expediently enclose the grip eye in annular fashion.

Particularly suitable for use as the bearing arrangement is a grip eye with an outer radial surface of essentially cylindrical shape which contacts the inner radial surface of the handle eye, which is likewise of essentially cylindrical shape, without any clearance. The relatively simple cylindrical design of the surfaces means that the far more complicated curved surfaces pursuant to DE-B-2811398 are avoided, where the corresponding radii have to be identical in order to prevent areas trapping hair and areas with too much clearance. In the scissors according to the invention, the cylindrical surfaces permit the grip eye to be inserted in the direction of the axis perpendicular to the handle eye with little or no clearance.

The outside of the grip eye preferably displays chamfers in the vicinity of the guide elements to facilitate insertion in the handle eye. To facilitate removal, the guide elements can also display chamfers on the inside, which can correspond with chamfers arranged on the outside of the handle eye.

A semi-rigid plastic material, for example—particularly Teflon—or a polyamide which is as flexible as possible can be used as the flexible material for the grip eye, ensuring low sliding friction of the grip eye in the mostly metallic handle. The grip eye can be easily manufactured by an injection moulding process.

According to the invention, the task is solved, on the other hand, in that the grip eye is composed of two ring halves, arranged axially to one another and each displaying guide elements projecting radially outwards on their outer face-ends, and an inner ring made of flexible material, which encompasses the outside and inside of the two ring halves, at least in some areas.

This configuration has the advantage that the two ring halves can be laterally inserted into the handle eye without clearance and without meeting any resistance. In order to retain the two ring halves in the handle eye, only the flexible inner ring which encompasses the inside and outside of the two ring halves is inserted laterally.

The two ring halves are preferably made of metal. In addition to manufacturing-related advantages, this also results in friction coefficients which are perceived as desirable when using the scissors. A certain amount of friction between the grip eye and the handle eye contributes to good control of the scissor movement and reliable guidance of the scissors.

If the friction which occurs when guiding the grip eye in the handle eye is to be reduced to a desired amount, the two ring halves can be provided with an anti-friction coating on their outer radial sides. Furthermore, the guide elements can display chamfers on their inner sides, which also reduce the friction in these areas.

In a preferred configuration, the handle eye belonging to the rotatable grip eye displays grooves running in the direction of the circumference on its inner radial side, these reducing the contact surface between the handle eye and the grip eye and collecting any particles of dirt, which likewise reduces friction.

In order to give the thumb particularly good support in the grip eye, recesses or projections running coaxially can be provided on the inner radial side of the inner ring made of flexible material.

BRIEF DESCRIPTION OF THE DRAWINGS

Two preferred practical examples of the invention are described in more detail below on the basis of the drawings. The drawings show the following.

DESCRIPTION OF THE PREFERRED EMBODIMENTS

Figure 1:
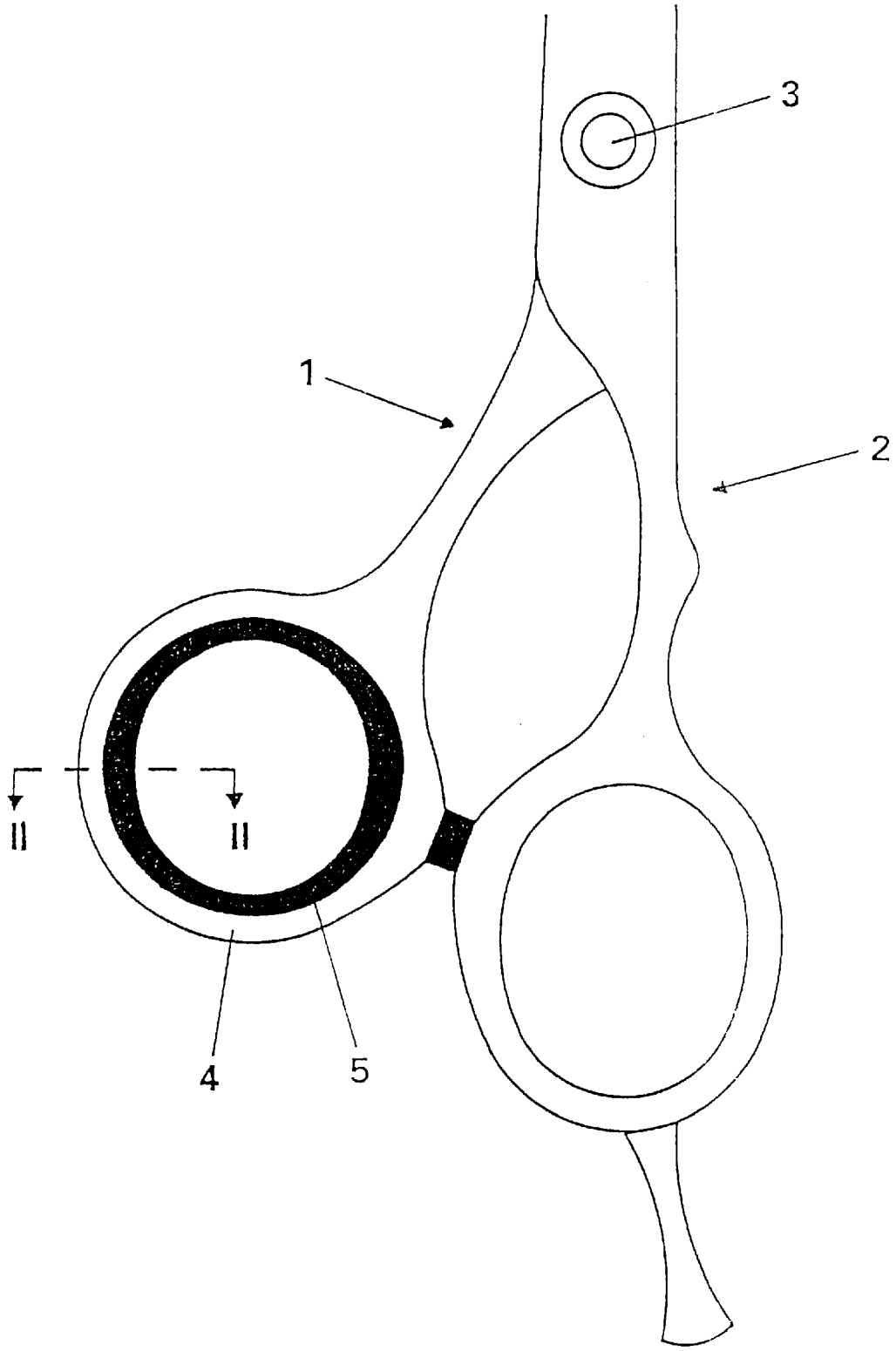
FIG. 1 part of a pair of haircutting scissors pursuant to the first practical example, FIG. 2 a section along Line II—II in FIG. 1 rotated 90°, FIG. 3 a top view (top) and a side view (bottom) of the grip eye pursuant to the first practical example, FIG. 4 part of a second practical example of haircutting scissors, FIG. 5 a section along Line V—V in FIG. 4, FIG. 6 a section through the two ring halves of the practical example pursuant to FIG. 4, FIG. 7 a section through the inner ring of the practical example pursuant to FIG. 4, and FIG. 8 part of an enlarged sectional view of the handle eye of the practical example pursuant to FIG. 4.

FIG. 1 shows haircutting scissors with a first handle 1 and a second handle 2, where handles 1 and 2 are connected in articulated fashion by means of a pivot screw 3. A qrip eye 5 is arranged in the handle eye of handle 1 and can be freely rotated in relation to handle eye 4 about an axis perpendicular to grip eye 5. Grip eye 5 as enclosed by handle eye 4 along its entire circumference.

Figure 2:
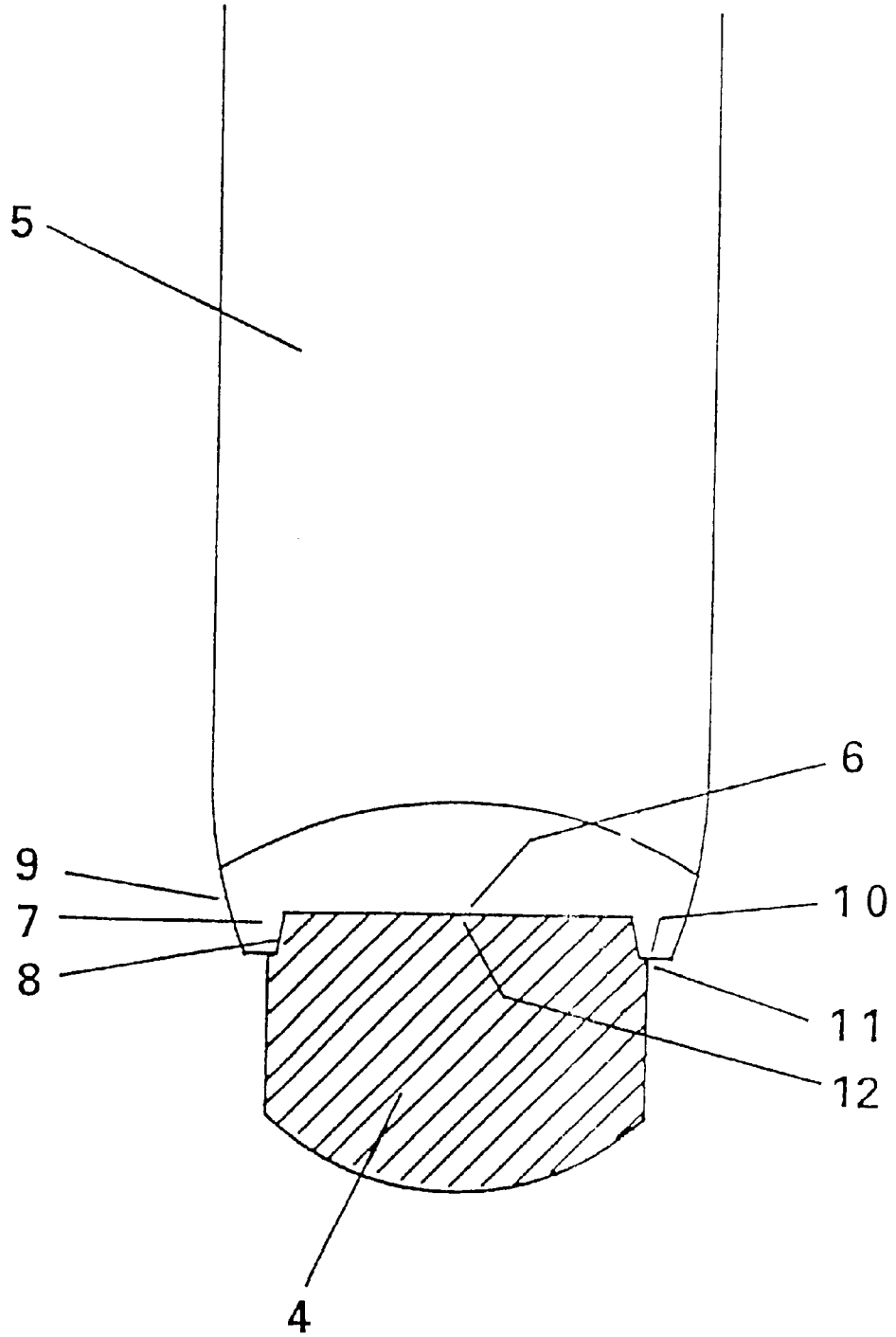

As FIG. 2 shows, grip eye 5 displays a cylindrical outer surface 6 which is laterally limited by two guide elements 7 projecting radially outwards. Guide elements 7 simultaneously limit cylindrical surface 12 of Lhe handle eye, which contacts surface 6 of grip eye 5 without any clearance. Guide elements 7 are also of annular design.

Guide elements 7, which laterally limit grip eye 5 and are integrally moulded to it, display chamfers 8 on their inner sides facing handle eye 4, these matching chamfers arranged on the outside of handle eye 4, meaning that guide elements 7 and cylindrical surface 6 of grip eye 5 lie flush against handle eye 4 on all sides without any clearance. The inward-facing areas of outer side 10 of radially outward-facing guide elements 7 are guided on a shoulder 11 of handle eye 4, ensuring exact positioning of guide elements 7 on handle eye 4. Furthermore, guide elements 7 display outer areas 9 curved outwards in the manner of chamfers, thus avoiding sharp edges between guide elements 7 and grip eye 5.

Grip eye 5 can be inserted into and removed from the handle eye in the direction of the axis perpendicular to the grip eye. In this context, guide elements 7 projecting radially outwards are flexibly deformed and snap into the inwardly cranked areas of handle eye 4 when grip eye 5 is in its proper position. In order to permit easy insertion and removal of grip eye 5 and, at the same time, to ensure that it is guided without clearance within handle eye 4, the inclination of chamfers 8 on the inner side of guide elements 7 is adapted to the hardness of the material of the guide elements. The chamfers can be designed as slopes with a constant inclination or they can, for example, display outward-curving areas.

Grip eye 5 is made of a soft Teflon material which displays a low coefficient of sliding friction in relation to the metallic handle eye and simultaneously feels pleasant to grip. Grip eye 5 is manufactured with integrally moulded guide elements 7 by an injection moulding process.

Figure 3:
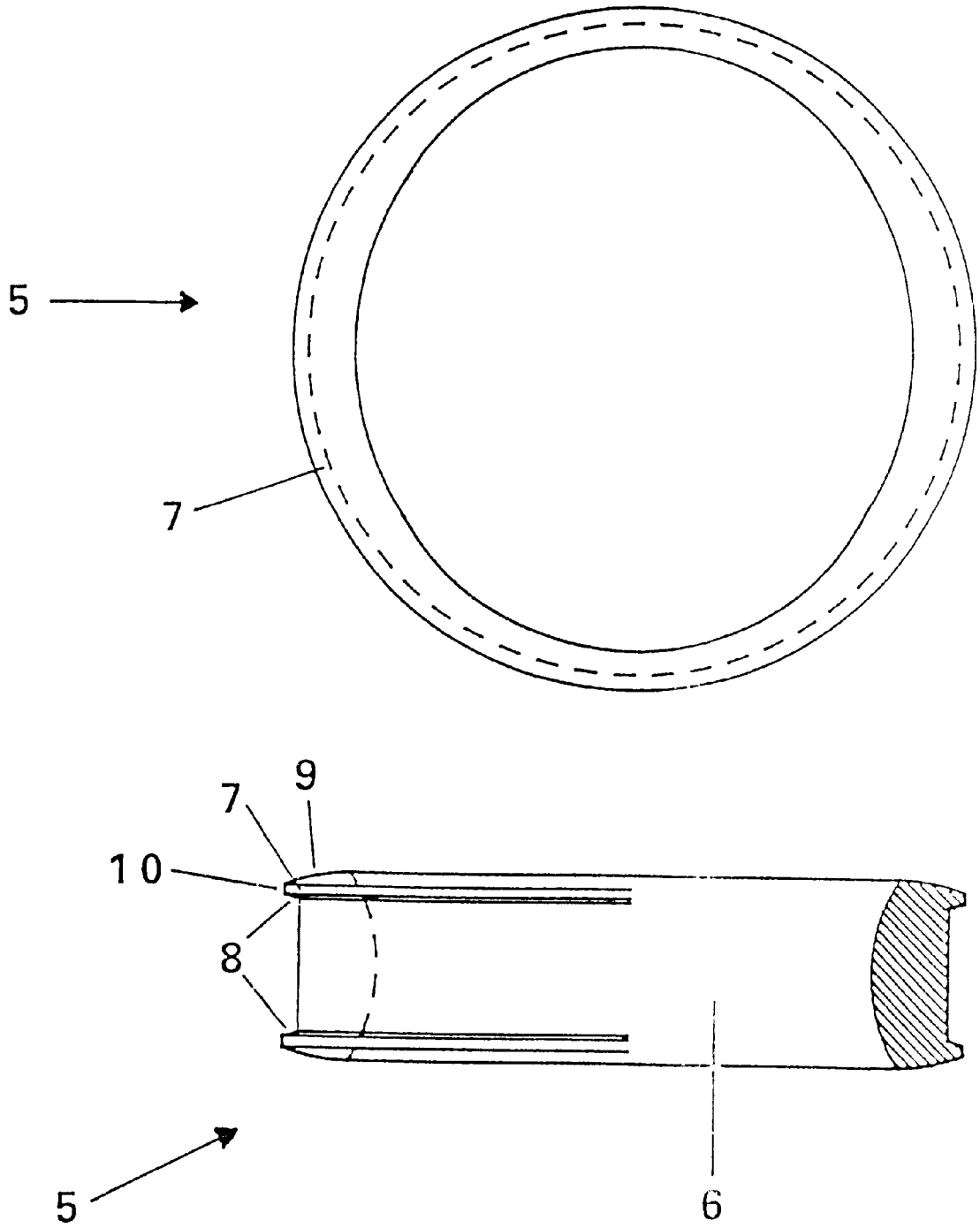

As FIG. 3 shows, grip eye 5 displays a rotationally symmetrical outer contour and an ergonomically adapted Liner contour, meaning that pressure marks on the thumb guided in grip eye 5 are avoided. It goes without saying that the second handle 2 of the scissors can also be provided with a corresponding grip eye.

In the practical examples shown in FIGS. 4 to 8, grip eye 13, as FIG. 5 shows particularly clearly, consists of two ring halves 14 and 15, arranged axially to one another and each displaying guide elements 7 projecting radially outwards on their outer face-ends, and an inner ring 16 made of flexible material which encompasses the inside and outside of the two ring halves 14 and in the vicinity of guide elements 7. The inward-facing face-ends of the two ring halves 14 and 15 contact one another.

The two ring halves 14 and 15 shown separately in FIG. 6 display annular guide elements 7, as in the practical example shown in FIGS. 1 to 3. These are provided with a chamfer 8 on their inner sides, in order to reduce the lateral friction on handle eye 4. Furthermore, ring halves 14 and 15 made of metal are provided with an anti-friction coating—of titanium nitride, for example—(not shown in the drawing) which reduces the friction between rotatable grip eye 13 and handle eye 4 even further. A certain amount of friction is, however, desirable, so that optimum control of the scissor movement and reliable guidance of the scissors are ensured during rotation of grip eye 13 when using the scissors.

In order to achieve a certain amount of friction, grooves 17 running in the direction of the circumference are provided on the inside of handle eye 4. Furthermore, grooves 17 collect any particles of dirt occurring between handle eye 4 and ring halves 14 and 15, meaning that perfect sliding or grip eye 13 in handle eye 4 is ensured.

As FIG. 7 shows particularly clearly, inner ring 16, which is made of a flexible material—for example, a flexible plastic—displays a curved contour on its inner surface and lateral face-ends. A rectangular groove 18 is moulded on its outer radial surface, with which the inside and outside of the two ring halves 14 and 15 are enclosed in the vicinity of guide elements 7, as shown in FIG. 5. Lateral surfaces 19 of snap-ring groove 18 extend over the entire height of guide elements 7, meaning that the two ring halves 14 and 15 are enclosed by the lateral beads of the inner ring on the outside and sharp edges are thus avoided.

Inner ring 16 is preferably made of transparent plastic, so that any colour coding of the two ring halves 14 and 15 is visible. On the other hand, the inner ring can consist of coloured plastic and be available in different sizes marked by different colours and intended for different thumb sizes.

As FIGS. 4, 5 and 7 further show, the inner radial side of the inner ring is provided with small coaxial ribs 20, which ensure optimum support of the thumb in the rotatable grip eye 13.

Grip eye 13 illustrated in FIGS. 4 to 8 can be easily fixed on handle eye 4 by initially inserting ring halves 14 and 15 into handle eye 4 from both sides. Inner ring 16 made of flexible material is then slipped over the two ring halves 14 and 15 from the inside. Inner ring 16 lies against the two ring halves 14 and 15 with radial and axial pre-tension, meaning that these are held together under a certain pressure. Grip eye 13 can be removed from handle eye 4 just as easily by performing the above actions in reverse order.

What is claimed is:

1. Scissors comprising a pair of legs, means for pivotally joining said legs at medial portions thereof, each leg having a cutting blade portion and a handle portion located at opposite sides of said medial portions, each handle portion including an opening having an axis, an annular grip eye being mounted for free rotation substantially within one of said handle portion openings about the axis thereof, said one handle portion opening being bordered by opposite border surface portions of said one handle portion, said annular grip eye having a pair of axially spaced radially outwardly projecting substantially continuous circumferential ribs in predetermined axial spaced relationship to each other and in axially intimate embracing relationship with said opposite border surface portions for preventing inadvertent or accidental axial removal of said annular grip eve from within and pivoting relative to said one handle portion opening, said annular grip eye being constructed from flexible material means for axially snap-inserting and axially snap-removing said annular grip eye relative to said one handle portion opening, said opposite border surface portions being bridged by an innermost circumferential surface, and said opposite border surface portions are in inwardly converging relationship relative to said one handle portion opening axis.

2. The scissors as defined in claim 1 wherein said circumferential ribs each include an exterior annularly extending outwardly convexly curved surface.

* * * * *